US005711240A

United States Patent [19]

Baker

[11] Patent Number: 5,711,240

[45] Date of Patent: Jan. 27, 1998

[54] INFLATABLE PONTOON FLOAT DEVICE

[76] Inventor: Norm Baker, P.O. Box 9007, Nampa, Id. 83652-9007

[21] Appl. No.: 526,711

[22] Filed: Sep. 11, 1995

[51] Int. Cl.[6] ..... B63B 1/14; B63B 7/08

[52] U.S. Cl. ..... 114/61; 114/345; 114/353

[58] Field of Search ..... 441/130, 40, 45; 114/61, 345, 353

[56] References Cited

U.S. PATENT DOCUMENTS

| | | | |
|---|---|---|---|
| 2,685,270 | 8/1954 | Pieraccioni Dit Pierac | 441/45 |
| 4,715,306 | 12/1987 | Horais | 114/61 |
| 5,248,271 | 9/1993 | Chu | 114/353 |
| 5,290,196 | 3/1994 | Steel | 441/130 |

FOREIGN PATENT DOCUMENTS

| | | | |
|---|---|---|---|
| 1294566 | 12/1962 | France | 114/61 |
| 3304702 | 8/1984 | Germany | 114/61 |

*Primary Examiner*—Sherman Basinger
*Attorney, Agent, or Firm*—Craig M. Korfanta

[57] ABSTRACT

A kick boat having: an integral frame and seat member which functions to comfortably support a user on a pair of inflatable pontoons; a pair of rigid wings attached to sides of the integral frame and seat member, where the wings include a concave lower surface having a radius approximately equal to the radius of the pontoons; the pair of pontoons, each being removeably attachable to the concave surface of one of the wings; and a backrest.

4 Claims, 15 Drawing Sheets

INFLATABLE PONTOON FLOAT DEVICE

BACKGROUND OF THE INVENTION

1. Technical Field

This invention generally relates floatation devices. More particularly, this invention relates to small boats or watercraft known as float tubes, kick boats and rafts for one or two people.

2. Background

Small personal floatation devices have become very popular among recreationalists and sportsmen. Fishermen, particularly fly fishermen, especially enjoy float tubes and kick boats because of the personal freedom to move about a body of water in a unintrusive manner. These devices employ some means of floatation to float a support upon which the sportsman sits.

In the case of float tubes, the floatation device is normally an inflatable ring or "U" shaped structure, similar to a tire inner tube, to which a textile or support saddle is attached. Normally, at least a portion of the user's legs are positioned below the surface of the water to allow the user to propel the craft across the body of water by kicking his or her feet. Swim fins are commonly used to improve the efficiency of the kick propulsion.

Recently, kick boats have experienced a surge in popularity. Kick boats are characterized by a pair of pontoons held in spaced parallel relation by a frame, which carries a seat upon which the user sits. Like the float tubes, the lower portion of the user's legs are positioned below the surface of the water to allow the user to propel the craft. One such kick boat is shown in U.S. Pat. No. 5,290,196 to Steel. This patent discloses a back packable kick boat which includes a foldable backrest to convert the kick boat from a sitting position to a backpack position. A tubular frame, preferably made of aluminum tubing, spans the pontoons. The frame is attached to the pontoons by strap loops, similar to belt loops, which encircle parts of the frame's tube. Stabilizing straps are attached to and span between the tops and bottoms of the pontoons to prevent the pontoons from flopping with respect to the frame. Unfortunately, the stabilizing straps do not completely prevent the pontoons from rotating about the frame which can make the craft unstable, especially in rough water. Additionally, this device is designed to be backpacked with the pontoons inflated and does not provide a convenient way to carry the device with the pontoons deflated. This makes it inconvenient to pack into a remote location, on narrow trails, etc. Finally, the design does not lend itself to a motorized version, nor a convenient way of adjusting the height of the seat with respect to the water level, as is necessary for users of differing weights.

Accordingly, objects of the invention include providing a lightweight, backpackable kick boat which can be conveniently carried with the pontoons deflated, providing a kick boat design with an adjustable seat height, an integral seat and frame, and a design which lends itself to both a motorized version and to expansion for multiple users.

SUMMARY OF THE INVENTION

These objects, as well as others, are satisfied by a kick boat having: an integral frame and seat member which functions to comfortably support a user on a pair of pontoons; a pair of rigid support wings attached to sides of the integral frame and seat member, where the wings include a concave lower surface having a radius approximately equal to the radius of the pontoons with each pontoon of the pair being removeably attachable to the concave surface of one of the wings; and a backrest.

In the preferred embodiment, the pontoons are inflatable, having an elastomer bladder enclosed in a durable nylon jacket, to provide flotation which is light weight, can be compacted and is easily transportable. The pontoons are attached to the wings using nylon straps and cooperating adjustable buckles. Generally a single strap is used to attach each pontoon. Each strap has a buckle attached to one of its ends. The other end of each strap is passed either through a slot in each of the support wings or through a slot in the integral frame and seat member, the slots in the frame and seat member being located adjacent to each wing. The strap is then placed around the circumference of the pontoon, its free end engaged with the adjustable buckle, drawn tight around the pontoon and secured into this position by the buckle. A backrest is attached to and extends substantially vertically upwards from the integral frame and seat member to provide support and comfort to the user. The backrests of the various embodiments are detachable to provide compact and convenient transport. Additionally, the entire assembly of each embodiment is designed to either disassemble or collapse to provide for both compact storage and convenient transport.

The support wings of the invention can be integrally formed with the frame and seat member, removeably attached to the frame and seat member or hinged to the frame and seat member. Currently, the preferred methods are to have the wings either removeably attached or hinged to the frame and seat member. In the embodiment in which the wings are removeably attached to the seat member, an adjustable attachment for the wings is provided which allows the user to adjust the seat height with respect to the pontoons. This feature allows the kick boat to be configured for users of differing weights so that a heavier user is not sitting at or below the surface of the water while a lighter user is not sitting too far above the water surface.

FIGURE DESCRIPTION

DETAILED DESCRIPTION OF THE INVENTION

Referring now to the figures, four embodiments of kick boats, constructed in accordance with this invention, are illustrated in detail with the first embodiment being generally designated as basic kick boat 100, the second embodiment being generally designated as backpack kick boat 200, the third embodiment being generally designated as motorized kick boat 300 and the fourth embodiment being generally designated as dual motorized kick boat 400. The basic elements which all four embodiments have in common are: an integral frame and seat member which functions to comfortably support a user on the floatation means; a pair of rigid wings attached to sides of the integral frame and seat member, where the wings include a concave lower surface having a radius approximately equal to the radius of the pontoons; a pair of pontoons, each being removeably attachable to the concave surface of one of the wings; and a backrest. The integral frame and seat members of the various embodiments are currently manufactured from fiberglass and finished with a gel coat to provide a strong and lightweight construction. However, it should be noted that other materials, such as polyethylene, could be used and may provide additional or other benefits.

The pontoons are, in this preferred embodiment, inflatable, having an elastomer bladder enclosed in a durable nylon jacket. It also should be noted that this invention could employ other types of pontoons, including pontoons made of polystyrene, plastic and metal, for example. The pontoons are removably attachable. Here, the pontoons are attached to the wings using nylon straps and cooperating adjustable buckles. In the preferred embodiments, a single strap assembly is used to attach each pontoon. The strap has a buckle attached to one of its ends. The other end of the strap is passed through a slot in the integral frame and seat member which is located adjacent to the particular wing. The strap is then placed around the circumference of the pontoon, its free end engaged with the adjustable buckle, drawn tight around the pontoon and secured into this position by the buckle. The pontoons can also be attached via numerous other removable attachment devices such as Velcro, snaps or the like. A backrest is attached to and extends substantially vertically upwards from the integral frame and seat member to provide support and comfort to the user. The backrests of all four embodiments are detachable to provide compact and convenient transport. Additionally, the entire assembly of each embodiment is designed to either disassemble or collapse to provide for both compact storage and convenient transport.

Figure 1:
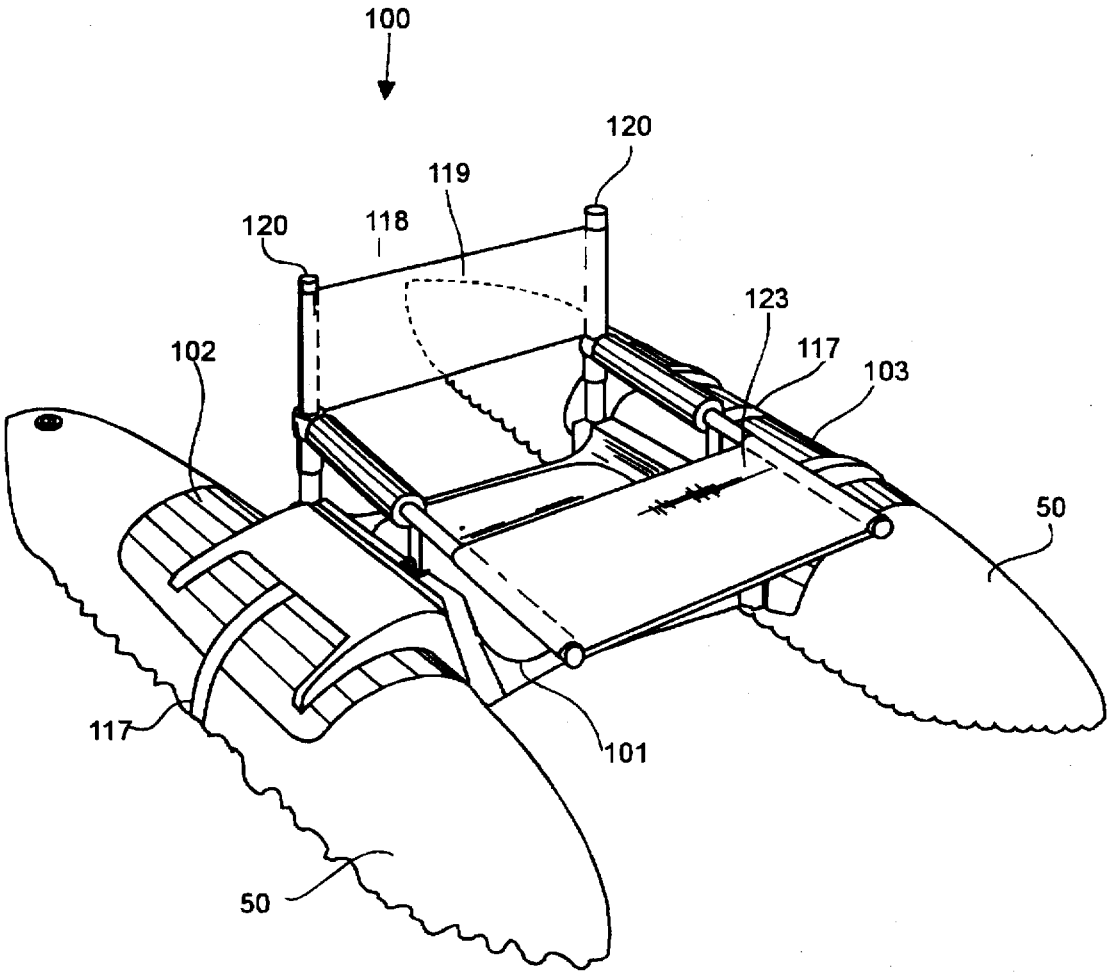
FIG. 1 is an elevation view of a first embodiment of a kick boat according to the invention.
Figure 2:
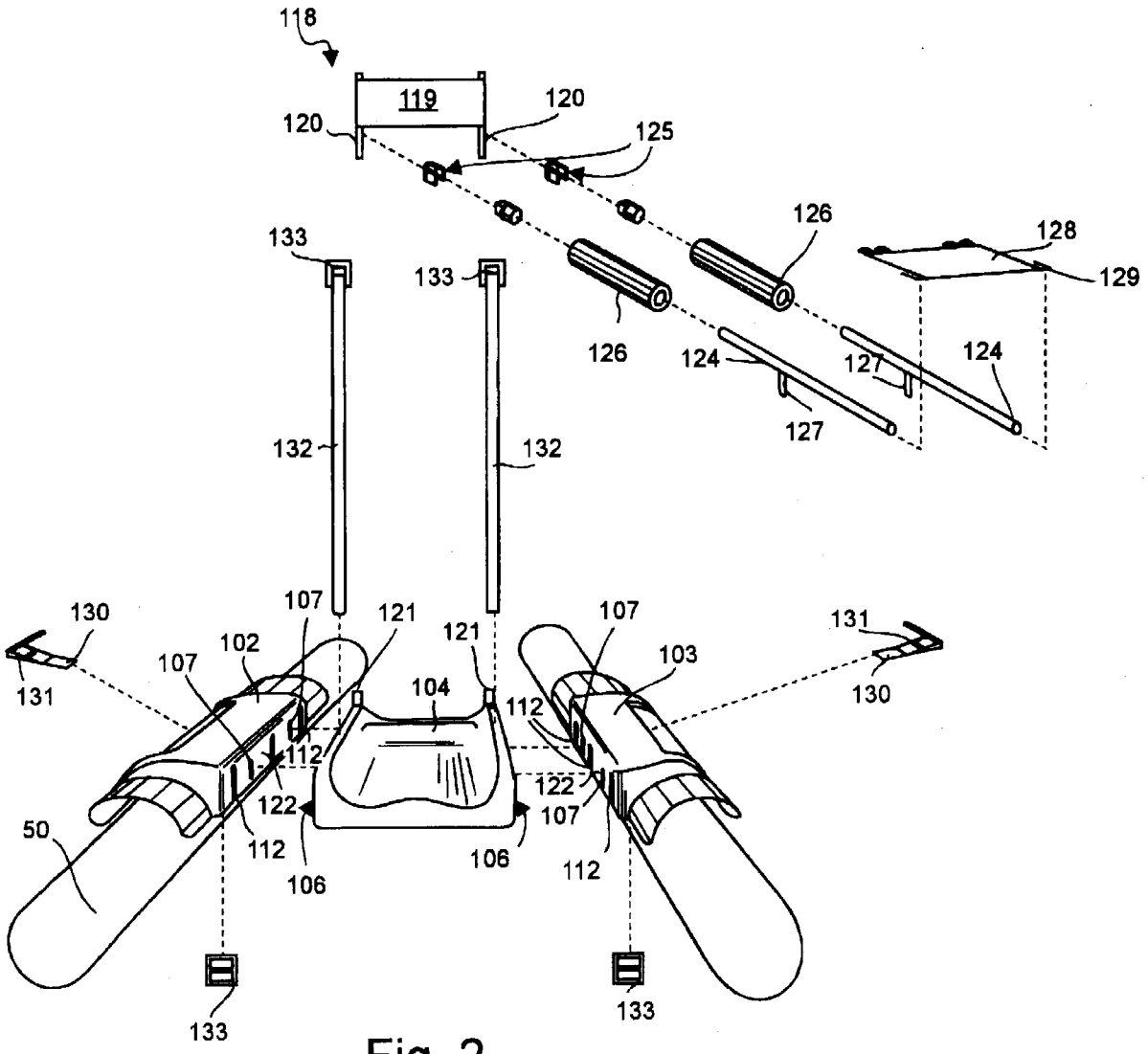
FIG. 2 is an exploded assembly view of the first embodiment.
Figure 3:
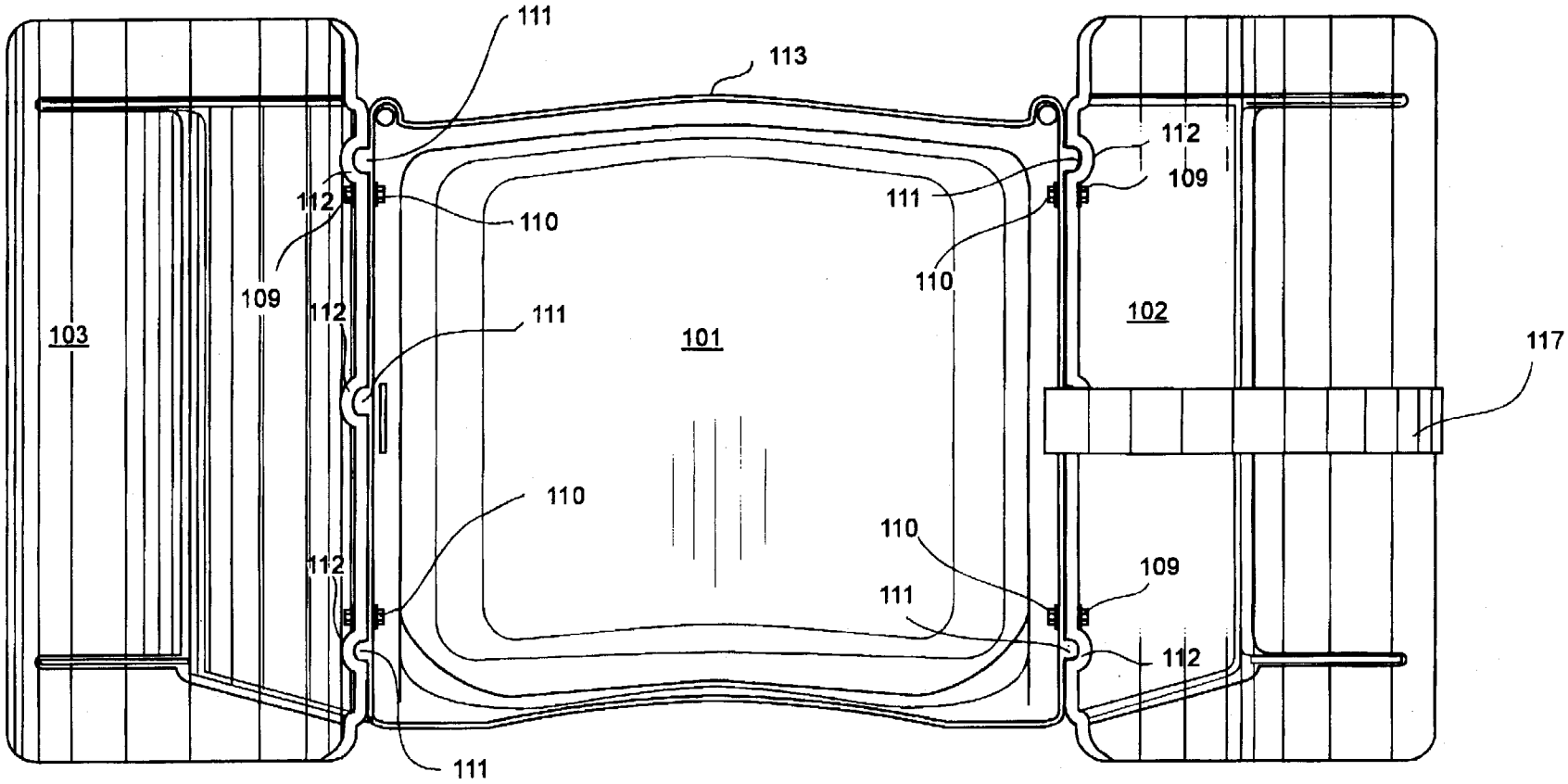
FIG. 3 is a bottom view of the integral frame and seat member and wing support assembly.
Figure 4:
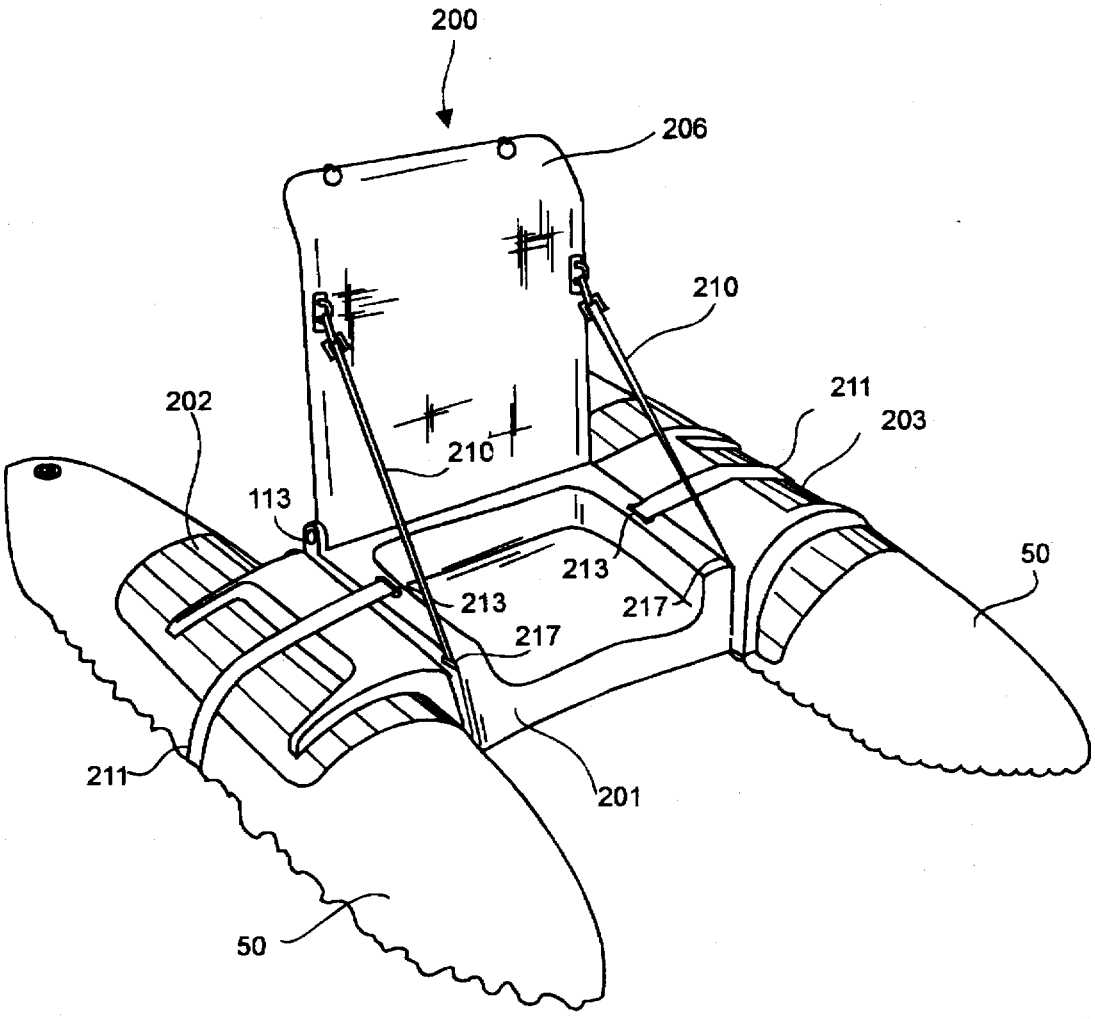
FIG. 4 is an elevation view of a backpack kick boat embodiment according to the invention.
Figure 5:
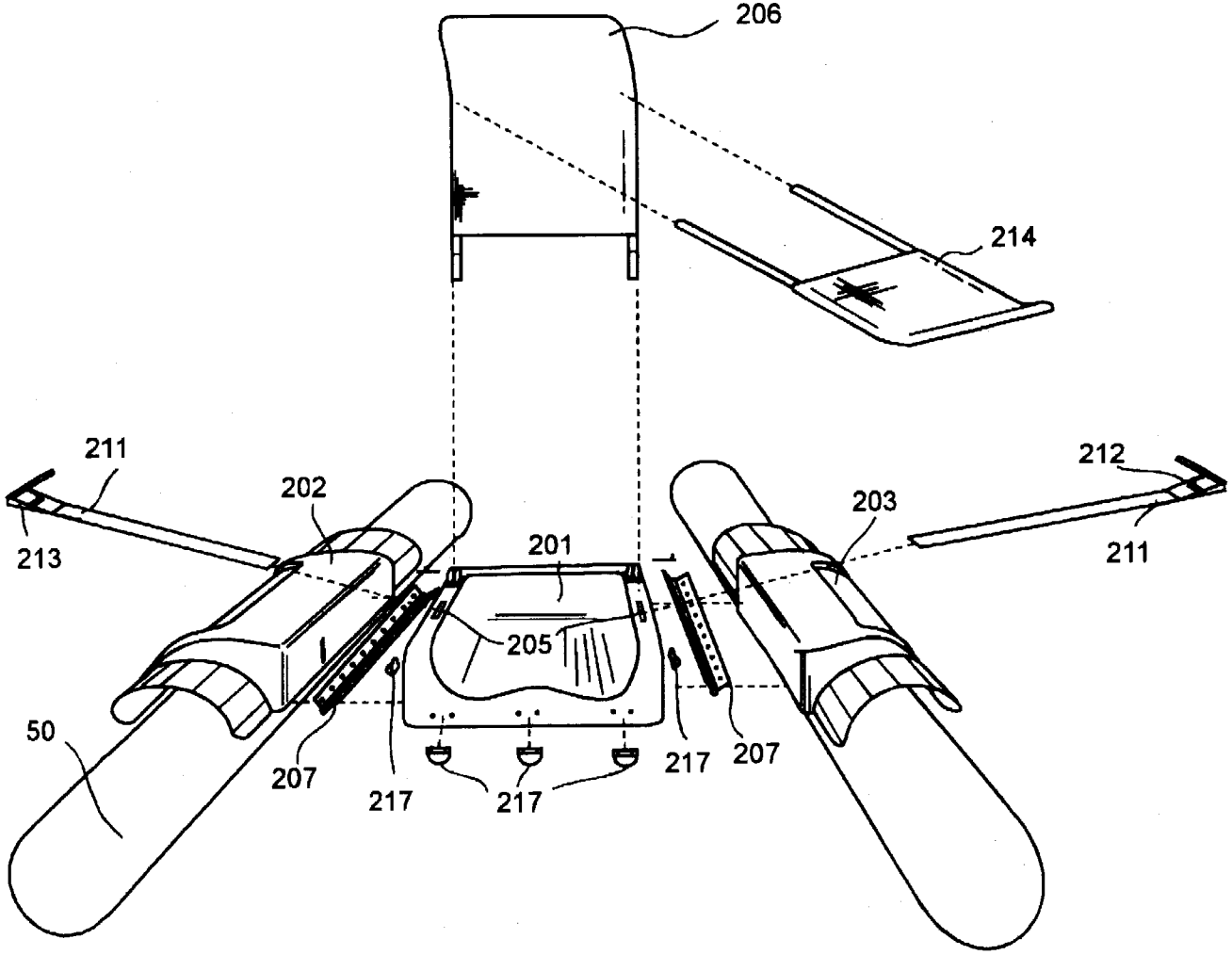
FIG. 5 is an exploded assembly view of the backpack embodiment.

FIGS. 1 through 3 show the first embodiment of the invention, referred to as basic kick boat 100. Kick boat 100 includes an integral frame and seat member 101 having right and left support wings 102 and 103 removably attached to side surfaces 106. Seat member 101 is in this preferred embodiment formed of molded fiberglass and includes a contoured upper sitting surface 104 to aid in the comfort of the user. In the preferred embodiments all of the fiberglass is finished with a gel coat which can be colored as desired.

Mating side surfaces 122 are provided on both right and left support wings 102 and 103. Side surfaces 106 and 122 include a cooperating registration means to align wings 102 and 103 with seat member 101. Here, the registration means comprises three cooperating bosses 111 and grooves 112. Registration bosses 111 are formed in side surfaces 106 and registration grooves are formed in side surfaces 122. Bolt mounting slots 107 are provided in side surfaces 122 to receive wing mounting bolts 109 and secure wings to seat member 101 via cooperating nuts 110. The slots provide an adjustment feature for seat member 101 to adjust its height with respect to wing supports 102 and 103. This feature allows a variable height to compensate for differing displacements to the differing weights of users. Slots 107 can be eliminated and replaced with multiple holes for limited preset adjustments or a single hole if no adjustment is desired.

Support wings 102 and 103 are similarly formed of molded fiberglass and similarly finished. Each wing has a cylindrically concave underside surface dimensioned to receive an inflatable pontoon 50. The underside surfaces should have an arc of curvature of greater than 90° and less than 180°, preferably between approximately 150° and 170°. In the preferred embodiments a single pontoon strap 117 secures each pontoon 50 to one of the wing supports. In this particular embodiment, each pontoon strap 117 is comprised of a short buckle segment 130 fixed at a first end to a wing support and having an adjustable buckle 131 attached to its other end. A longer strap segment 132 extends from the underside of seat member 101 having a first end attached to the seat member and a second end, which is received by buckle 131 after it is passed around pontoon 50. Straps 131 and 132 are attached at their first ends to their respective structures using a slot and keeper arrangement which has each strap inserted through a slot in the structure and that end of the strap fixed to a keeper 133. It should be noted that pontoon straps 117 can be, and in the second embodiment are, a single length of strap with an adjustable buckle at on end passing through one of a pair of slots in seat member 101, each slot being adjacent one of the wing supports. Additional modifications include manufacturing seat member 101 and wing supports 102 and 103 as a single integral piece.

A backrest 118 is detachably mounted at the back edge of upper sitting surface 104. Backrest 118 has a pair of backrest uprights 120 removably attached to opposing back corners of seat member 101, extending generally vertically upward therefrom. Here, this is accomplished by a pair of upright stubs 121 which extend a short distance upward from upper sitting surface 104 at the opposing corners. Upright stubs 121 are either formed integrally with seat ember 101 or later fixed into position and have an outside diameter slightly less than the inside diameter of backrest uprights 120 so that the stubs can be slidably received by the uprights. Detent pins or similar coupling devices are used to fix uprights 120 into their backrest position. A backrest web 119 spans the upper portions of uprights 120 to complete backrest 118. Web 119 is here an elongated rectangular panel of loosely woven nylon net material with the end portions sewn back onto the panel to form sleeves to receive uprights 120.

An apron assembly 123 is optionally attached to uprights 120 to provide a working surface for the user. Apron assembly 123 here has a pair of apron arms 124 pivotally attached via lug and bracket assemblies 125. Tubular cushions 126 surround the rear portions apron arms 124 to provide a comfortable and convenient resting place for the lower arms of user. A pair of apron arm supports 127 depend from approximately midpoints on apron arms 124 to secure apron 128 in a horizontal position in front of the user. Apron arm supports 127 are removably secured to the marginal edges of upper sitting surface 104 via a lug and bracket assembly 113 similar to that shown in FIG. 14. Lug and bracket assembly 113 has a lug 114 pivotally secured within lug bracket 115 via detent pin 116. Similar lug and bracket assemblies are used throughout the embodiments. An apron spanner bar 129 resides in a sleeve along the front edge of apron 128 and includes "L" shaped bent portions at either end which attach and support apron 128 at the front ends of apron arms 124, The bent portions are inserted and held in holes in caps on the front ends of apron arms 124. The rear portion of apron 128 is preferably drawn taught and held in the position by releasable elastic bands or bungee cords which are not shown.

A second embodiment of the invention is shown in FIGS. 4–8 and is generally designate as backpack kick boat 200. Backpack kick boat 200 has an integral frame and seat member 201 to which fight and left support wings 202 and 203 are hingedly attached. Right and left support wings 202 and 203 are attached at their lower inside edges to the lower marginal side edges of seat member 201 using wide piano type hinges 207. The hinge plates of hinges 207 are attached to the side surfaces of seat member 201 and the side surfaces of wing supports 202 and 203 via suitable fasteners 208, such as nuts and bolts. This configuration for hinges 207 allows wing supports to fold inward toward the underside of seat member 201, stopping when the outside edges of wing supports contact the underside, and outward, stopping when the side surfaces of the wing supports come into contact with the side surfaces of seat member 201.

Figure 6:
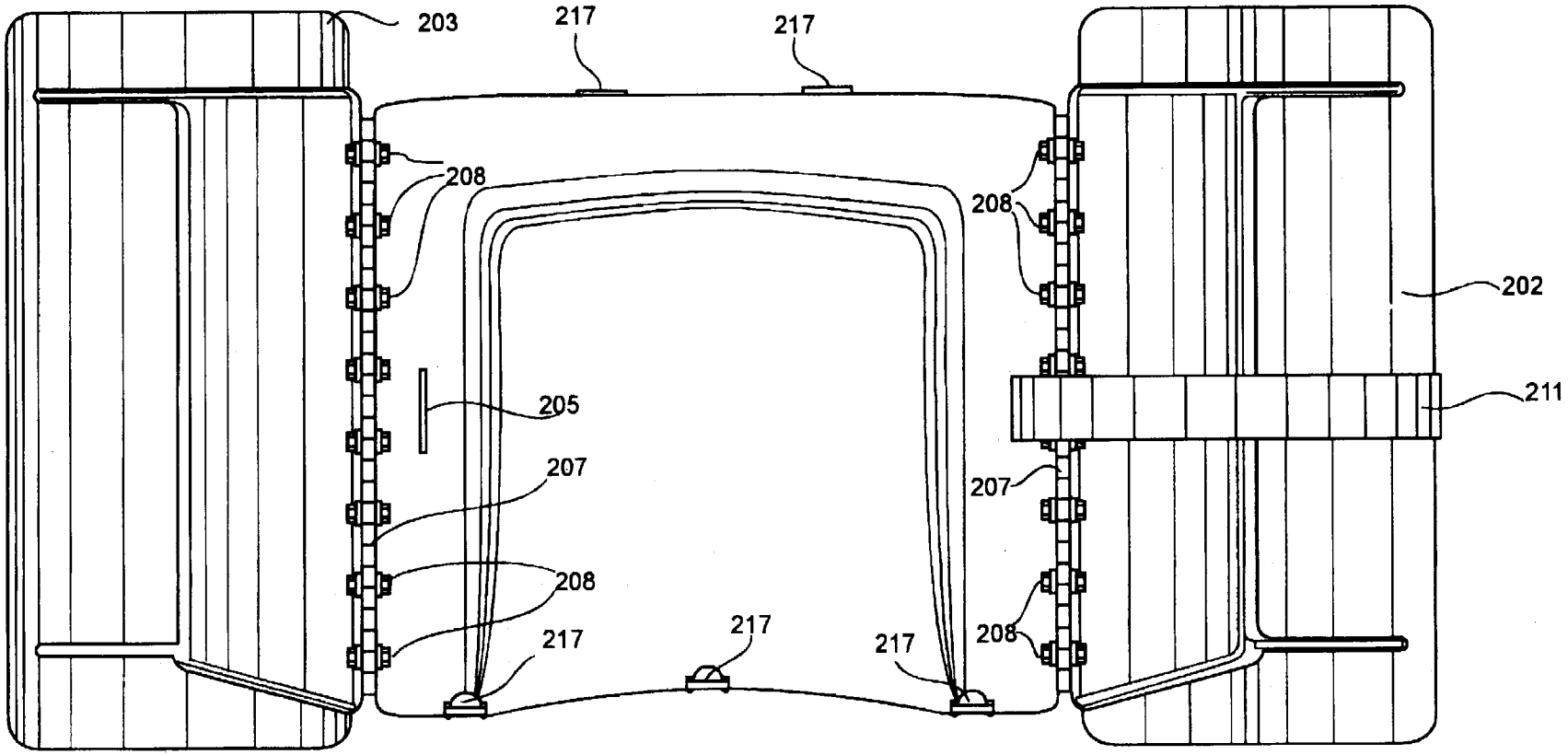
FIG. 6 is a bottom view of the backpack embodiment.
Figure 7:
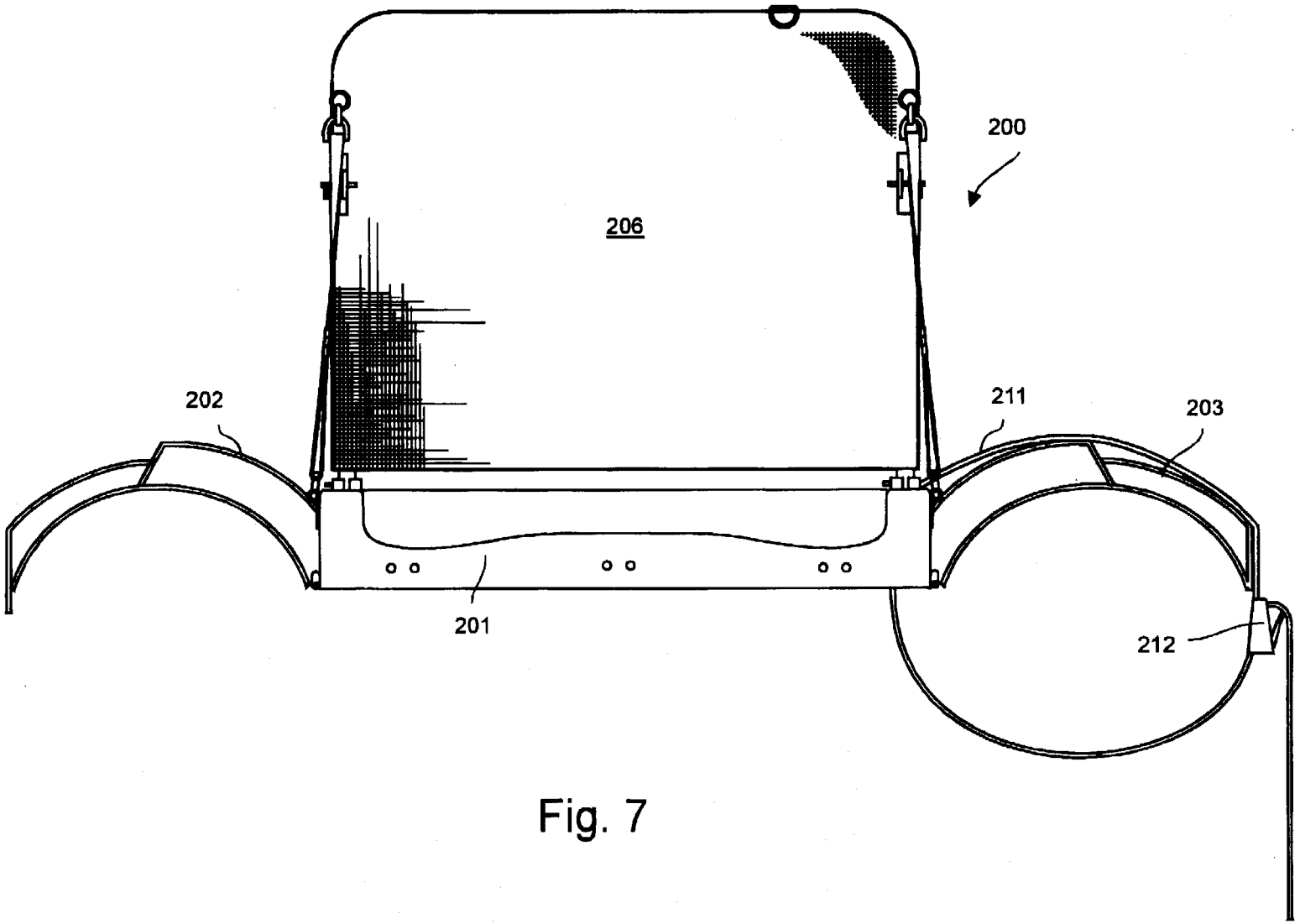
FIG. 7 is a front end view of the backpack embodiment.
Figure 8:
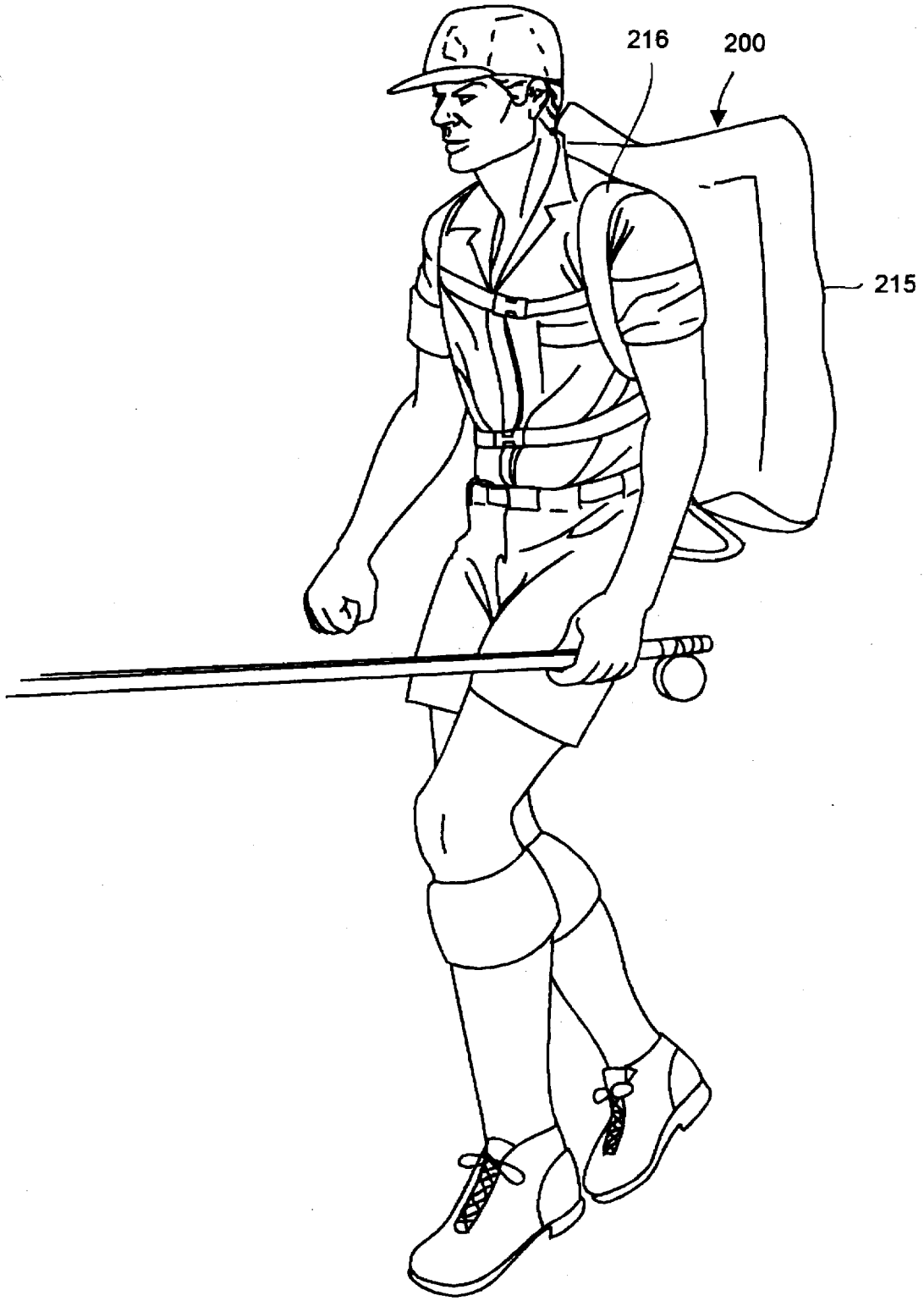
FIG. 8 is a perspective view of the backpack embodiment worn by a user.
Figure 9:
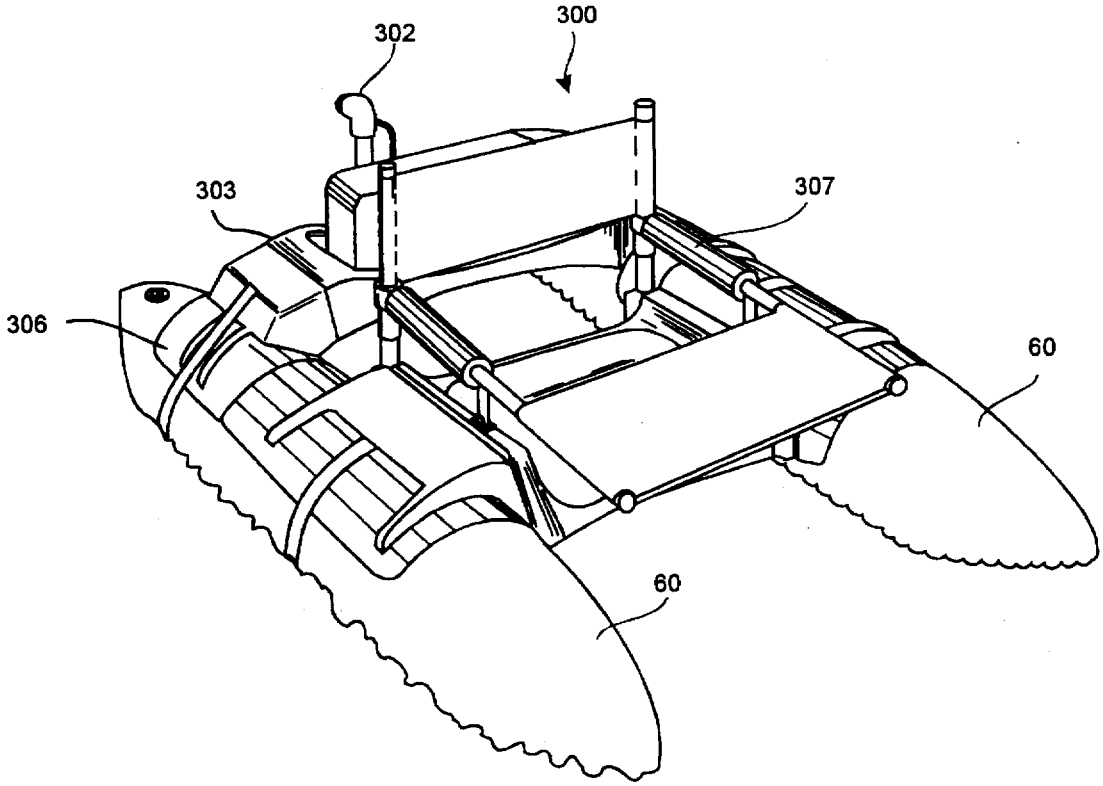
FIG. 9 is an elevation view of a third embodiment of a kick boat according to the invention.
Figure 10:
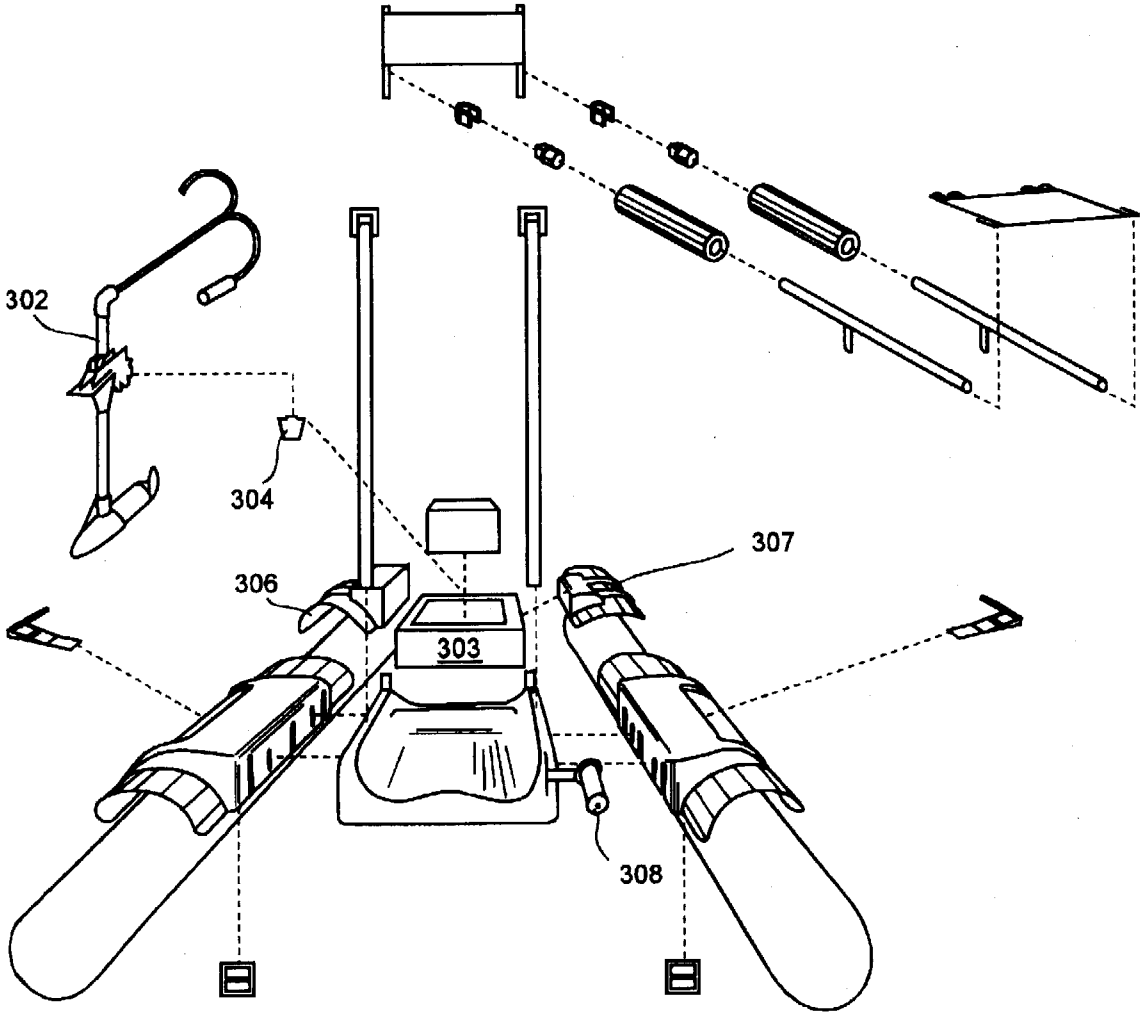
FIG. 10 is an exploded assembly view of the third embodiment.

The outward most position of wing supports 202 and 203 corresponds to the float position. It is in this position that floats 50 are attached to the concave underside surfaces of wing supports 202 and 203. Similar to the first embodiment, floats 50 are attached to their wing supports using a single pontoon strap 211. As mentioned earlier, this strap is a single continuous length having a buckle 212 at one end. The other end of the straps are passed through strap slots 205 in seat member 201. For the purposes of illustration, only one pontoon strap is shown in FIGS. 6 and 7. However, it should be understood that a similar strap is used to attach the second pontoon. Preferably, keepers 213 are installed part way down the length of straps 211 from buckles 212 so that when straps 50 are wrapped around pontoons 50 a convenient length of the strap is left over the upper surfaces of the wing supports to facilitate buckling.

Figure 14:
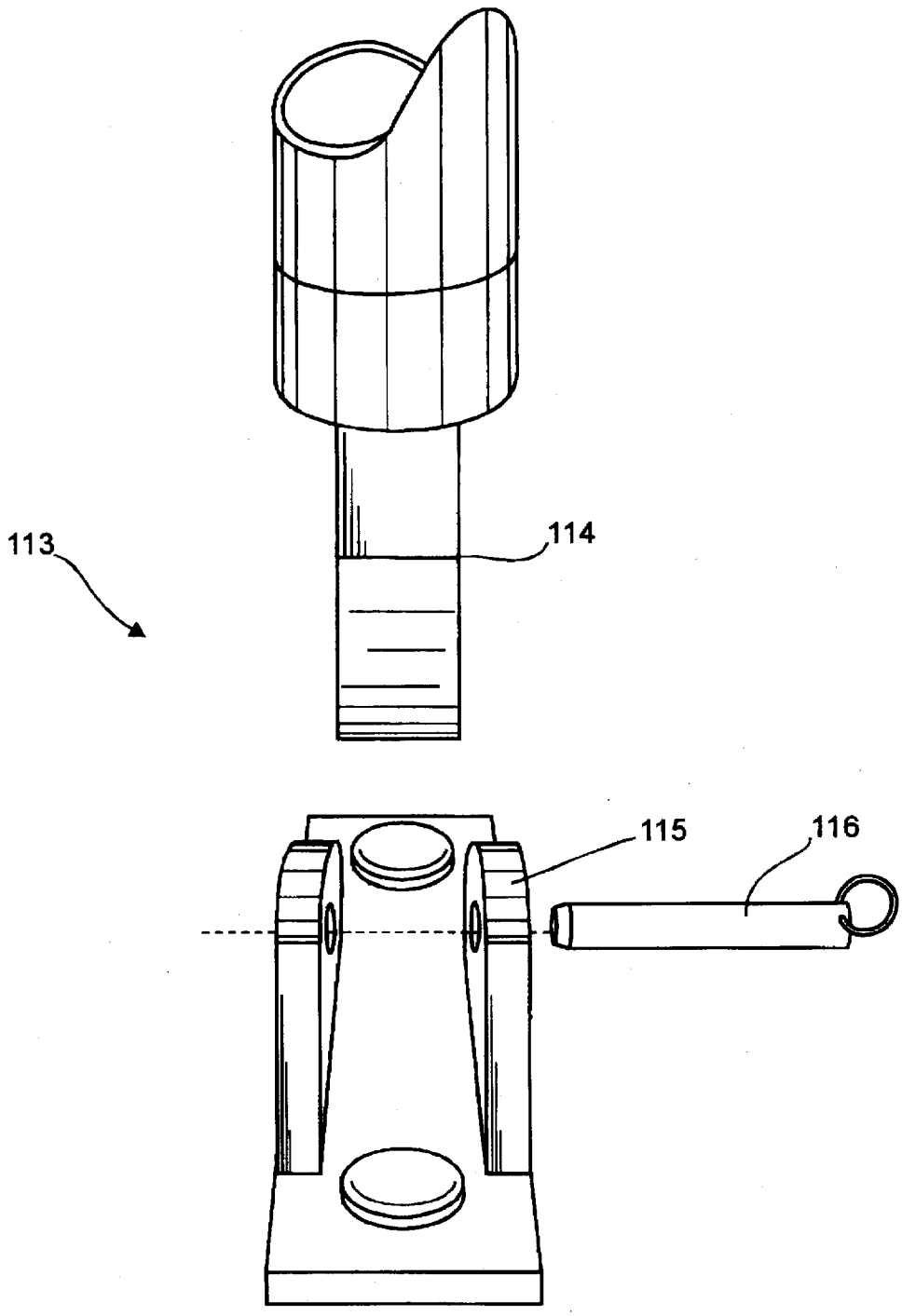
FIG. 14 is a detailed perspective view of a lug connector which is particularly suitable for use by the invention.

A back rest 206 is pivotally attached to the back edge of seat member 201 using a lug and lug bracket assembly 113 like that of FIG. 14. Back rest 206 is here constructed using a flat bottomed "U" shaped tube having a nylon net sleeve spanning the legs of the "U". Additionally, the upper portion of the back rest, which comprises the bottom of the "U" shape, is bent away from the neck and head of a user sitting in seat member 201. This serves two functions. First, when in the sitting/floating position, it is much more comfortable for the user not to be in contact with the upper cross member. Second, when in the backpack position, the bent portion acts as a kick or butt plate for the user so that the back of the user's legs do not come in contact with the pack. This feature will become more apparent below.

A pair of back rest support straps 210 are provided between back rest 207 and seat member 201 to prevent backrest 207 from rotating to a fully reclined position. Preferably, the lengths of straps 210 are adjusted to dispose back rest 207 just past vertical in a slightly reclined position.

Optionally, an apron 214 can be attached to the upright portions of back rest 207 to provide a working surface for the user. Additionally, the far end portion of apron 208 can be bent at an angle similar to that of back rest 207 so that it to can be used as the back rest/kick plate in the backpacking configuration. This provides the additional benefit of preventing articles from sliding off the front of the apron when the apron assembly is in its working surface position.

To configure backpack kick boat 200 in the backpacking position, straps 211 are removed. Straps 210 are unfastened and back rest 206 and apron assembly 214 are removed. Then either back rest 206 or apron assembly 214 is rotated 180°, side for side, and refastened into lugs 115, FIG. 14, but in a plane parallel to seat member 201 with the bent portion extending toward the underside of seat member 201. Straps 210 can be used to secure either back rest 206 or apron assembly 214 in this position. The entire seat and support wing assembly is then flipped over. Pontoons 50 are deflated and stowed in the compartment created by the underside of seat member 201, along with any other articles such as fishing tackle, the backrest or apron assembly, pontoon straps, etc. Support wings 202 and 203 are then folded inward to enclose the storage compartment. A nylon cover 215, preferably with an elastic band around its perimeter, is stretched over the upper and lower ends of support wings 202 and 203 to complete the storage compartment enclosure. Shoulder straps 216, preferably padded, are then attached to the front and back edges of seat member 201 at suitable attachment points such as "D" rings 217, or similar structure.

A third embodiment of the invention is shown in FIGS. 9–12 and is there designated as motorized kick boat 300. The basic seat, support wing and back rest assembly description of this embodiment is similar to that of the first embodiment and therefore will not be repeated here. Pontoons 60 are similar to the pontoons of the first embodiment but are preferably longer to provide additional stability and floatation for battery 301 and motor 302.

Figure 15:
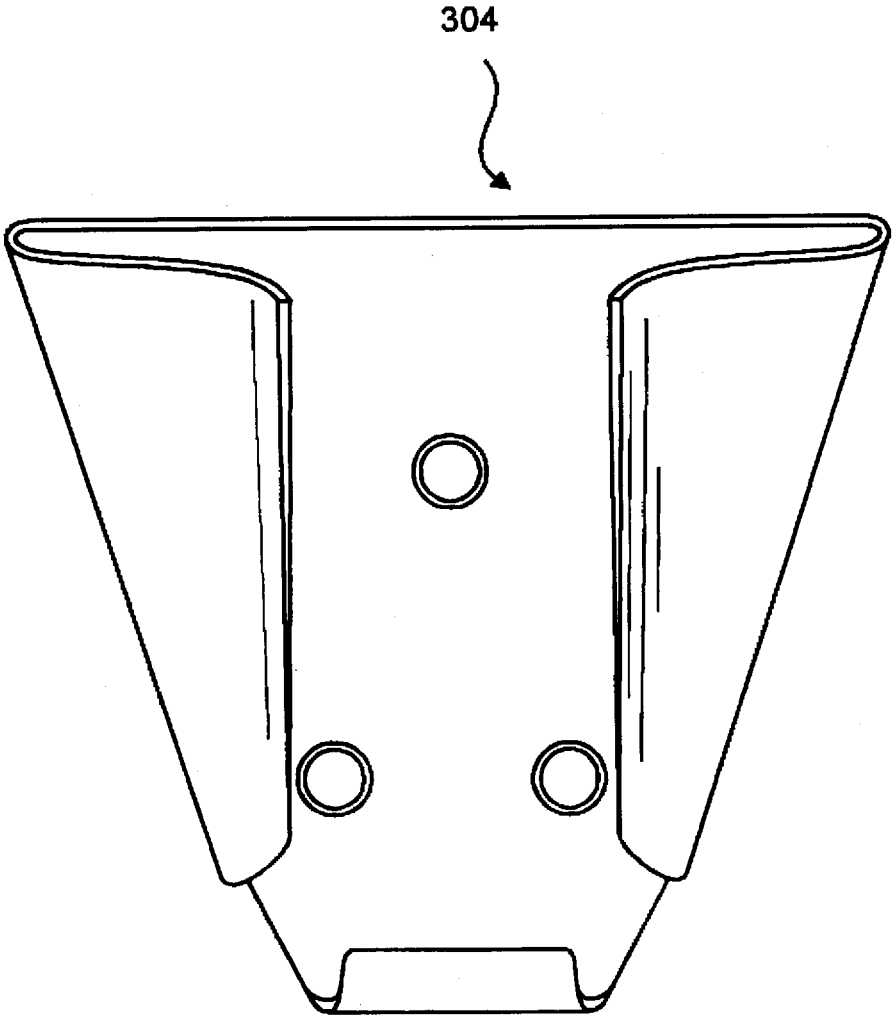
FIG. 15 is a back view of the transom bracket for mounting a motor.

An integral frame and battery mount member 303 is attached to pontoons 60 via battery and motor support wings 306 and 307. The upper surface of battery mount member 303 includes a battery receiving recess formed therein to receive and hold a standard 12 volt automotive or marine battery. Preferably, the recess is large enough to receive a marine battery enclosure to prevent the battery from being exposed to water and the elements. A suitable hold down can be provided if desired for the enclosure and or battery. Motor 302 can be a conventional electric trolling motor such as those manufactured by MiniKota. In this case, a suitable transom is provided at the back edge of battery mount member 303 to receive the transom bracket of the motor. Preferably, however, the traditional transom bracket on the motor is modified to be slidably received in the transom bracket shown in FIG. 15 and designated as 304. Transom bracket 304 is fixed to the back edge of battery mount member 303 and is configured such that motor 302 can be easily lowered into position and held there by gravity.

Figure 11:
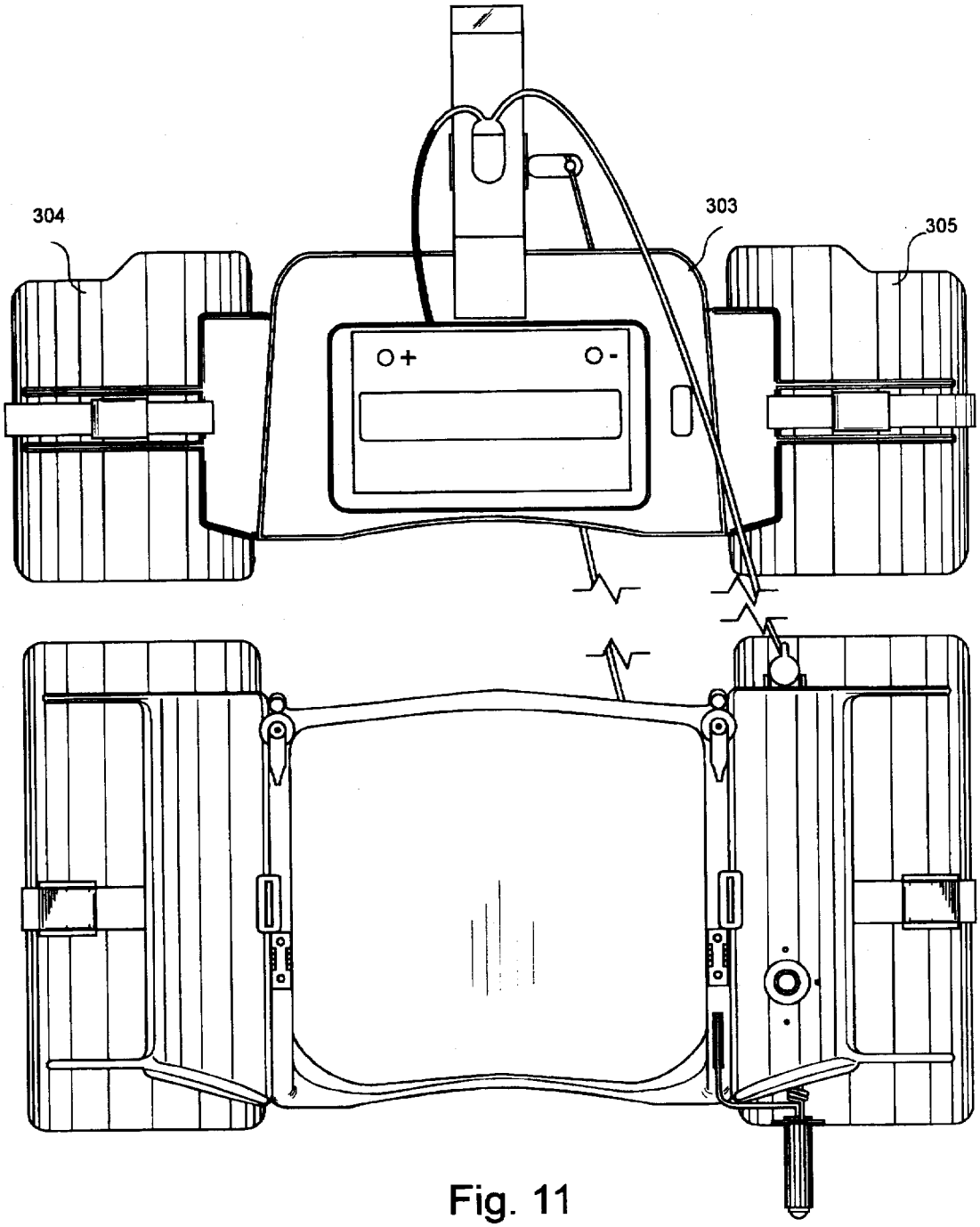
FIG. 11 is a top view of the third embodiment.
Figure 12:
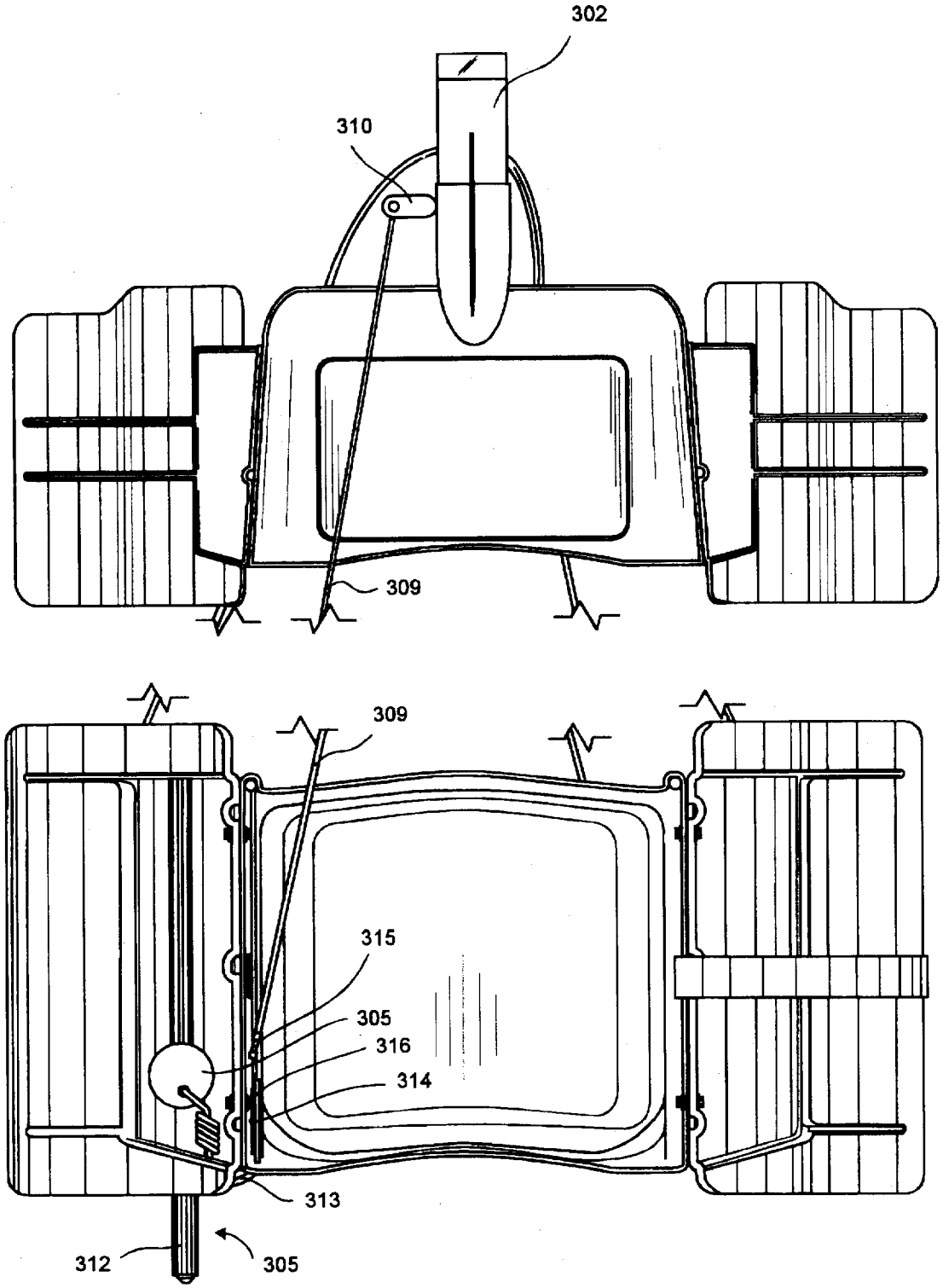
FIG. 12 is a bottom view of the third embodiment.

A motor speed and direction control box 305 is fixed to the underside of support wing 103 with a control knob 311 protruding upward to the upper surface of the support wing. A control lever 308 is pivotally attached to the inside surface of the side of the seat member. The upper end of control lever 308 extends outward above the upper sitting surface while the lower end extends below the seat member. Referring to FIG. 11, control lever 308 includes a grip portion 312 and a bent lever portion 313 which extends rearwardly projecting through slot 314 to the underside of the seat member and support wing 103 and is pivotally attached to the inside surface of the side of seat member. Referring to FIG. 12, bent lever portion 313 pivotally attaches to the underside of the seat member at pivot point 316 and attaches to control rod 309 by means of mechanical connector 315. A control rod 309 links the lower end of control lever 308 to idler arm 310. Idler arm 310 extends radially outward from the vertical shaft of motor 302. It should now be appreciated that pivoting control lever 308 in a vertical plane will cause a rotation of motor 302 about a vertical axis.

The mechanical connections between idler arm 310 and control rod 309, and between control lever 308 and control rod 309, are preferably accomplished using a detachable ball joint connector. The electrical connections between motor 302, battery 301 and control box 305 are accomplished using conventional electrical connectors.

Figure 13:
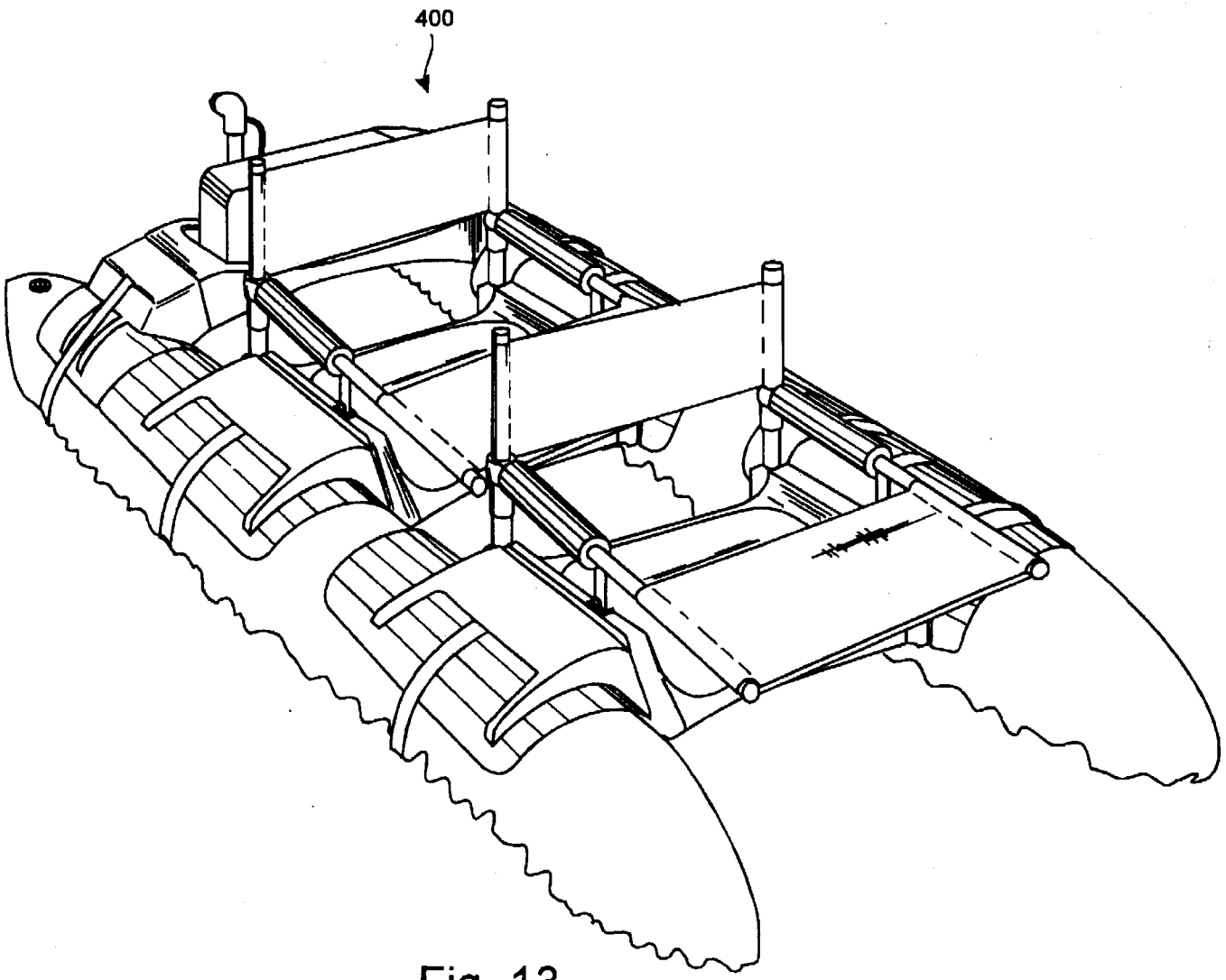
FIG. 13 is an elevation view of a fourth embodiment of the invention.

A fourth embodiment of the invention is shown in FIG. 13 and is generally designated as double motorized kick boat 400. Double motorized kick boat 400 is identical in most respects to the third embodiment. A second frame and seat assembly is added and the pontoons and control rod are lengthened. A fitch embodiment, not shown particularly, is the same as the fourth, except the motor is eliminated.

While there is shown and described the preferred embodiments of the invention, it is to be distinctly understood that this invention is not limited thereto but may be variously embodied to practice within the scope of the following claims.

We claim:

1. A floatation device comprising:

an integral frame and seat member, having an upper sitting surface, a bottom surface, a front edge, a back edge and two side edges;

a pair of rigid pontoon support wings, each being pivotally attached to, and extending from one of the side edges, the support wings being pivotal between a float position having the wings lying generally in the same plane as the integral frame and seat member and a backpack position having the wings folded inward and back toward the bottom surface of the integral frame and seat member to partially enclose a storage compartment;

a pair of inflatable pontoon floats;

attachment means for removably attaching each pontoon to one of the support wings;

a back rest member being removably attachable to the integral frame and seat member near its back edge; and a cover shaped and configured to be stretched over upper and lower ends of the support wings to complete the storage compartment enclosure and hold the wing members in their backpack position.

2. The floatation device of 1 wherein the support wings and the bottom surface of the integral frame and seat member are configured to form a compartment therebetween when the support wings are folded into the backpack position.

3. A floatation device comprising:

an integral frame and seat member, having an upper sitting surface, a front edge, a back edge and two side edges;

a pair of rigid pontoon support wings, each attached to, and extending from one of the side edges;

an integral frame and battery mount member having a battery receiving recess formed in an upper surface thereof and a pair of support wings attached thereto similar to the pontoon support wings;

a motor mounting bracket attachable to the integral frame and battery mount member;

a pair of inflatable pontoon floats; and attachment means for removably attaching each pontoon to one of the pontoon support wings.

4. The floatation device of claim 3 further comprising:

a steering control lever being pivotally attached to and through the integral frame and seat member and disposed to pivot in a generally vertical plane;

an idler arm member; and a control rod being attachable between a bottom end of the control lever and the idler arm member, wherein the idler arm member is disposed and configured so that a rotational displacement of the bottom end of the control lever in a vertical plane causes a horizontal rotational displacement of the idler arm.

* * * * *